US005215410A

United States Patent [19]

Karal

[11] Patent Number: 5,215,410

[45] Date of Patent: Jun. 1, 1993

[54] METHOD AND MEANS FOR CONTROLLED SUBMERSION AND POSITIONING OF LARGE, HEAVY GRAVITY ELEMENTS ON THE SEA BOTTOM

[75] Inventor: Karel Karal, Oslo, Norway

[73] Assignee: Norwegian Contractors, Stabekk, Norway

[21] Appl. No.: 745,238

[22] Filed: Aug. 14, 1991

[30] Foreign Application Priority Data

Aug. 14, 1990 [NO] Norway ..... 903554

[51] Int. Cl.[5] ..... E02D 29/06

[52] U.S. Cl. ..... 405/205; 405/203; 405/224; 405/188

[58] Field of Search ..... 405/171, 188, 195.1, 405/203, 205-208, 224, 224.1, 224.3, 172

[56] References Cited

U.S. PATENT DOCUMENTS

| | | | |
|---|---|---|---|
| 3,086,368 | 4/1963 | Popper | 405/224 |
| 3,394,553 | 7/1968 | Vidal | 405/224 X |
| 3,469,900 | 2/1970 | Mott et al. | 405/224 X |
| 3,474,749 | 10/1969 | Williamson | 405/207 X |
| 3,543,526 | 12/1970 | O'Neill et al. | 405/188 X |
| 3,756,034 | 9/1973 | Lochridge et al. | 405/171 X |
| 3,849,997 | 11/1974 | Gower | 405/172 X |
| 4,047,390 | 9/1977 | Boyce | 405/188 |
| 4,048,945 | 9/1977 | Shrum | 405/224 X |
| 4,102,137 | 7/1978 | Possaz et al. | 405/172 X |
| 4,377,354 | 3/1983 | Morton | 405/171 |
| 4,683,156 | 7/1987 | Waters | 405/20 X |
| 4,909,671 | 3/1990 | Skjong | 405/206 |

FOREIGN PATENT DOCUMENTS

| | | | |
|---|---|---|---|
| 7603200 | 9/1976 | Netherlands | 405/172 |
| 147690 | 2/1983 | Norway . | |

*Primary Examiner*—Dennis L. Taylor
*Assistant Examiner*—Arlen L. Olsen
*Attorney, Agent, or Firm*—Wenderoth, Lind & Ponack

[57] ABSTRACT

The immersion and positioning of a sink element on the sea bottom is controlled by providing a weight system suspended from the sink element. An auxiliary surface vessel has a control cable directly connecting the vessel with the weights system suspended from the sink element. The sink element is immersed with the weight system suspended therefrom and therebelow until the weight system contacts the sea bottom and the sink element reaches a preselected stabilized equilibrium elevational position above the sea bottom. Then the sink element can be laterally displaced while substantially maintaining the height of the sink element above the sea bottom by having the auxiliary surface vessel pull on the control cable connected to the weight system in a direction of movement towards the final location site. The weight system contacts the sea bottom during this movement to help control the movement of the sink element and minimize the influence of outside forces. When the sink element has substantially arrived at the final location site, the sink element is ballasted so that it will sink onto the site on the sea bottom. Buoyant floating bodies may be used for floatation and sinking of the sink element as well as mounting of the weight system.

25 Claims, 6 Drawing Sheets

METHOD AND MEANS FOR CONTROLLED SUBMERSION AND POSITIONING OF LARGE, HEAVY GRAVITY ELEMENTS ON THE SEA BOTTOM

BACKGROUND OF THE INVNETION (1) Field of the Invention

The present invention relates to a method and apparatus for submersion and positioning of large, heavy elements on a preselected site on the sea bottom.

The invention is particularly attractive in connection with large sea depths for elements having a weight of 1000–5000 tons or more which are to be installed with great accuracy in offshore areas with rough weather, in some cases in close vicinity of already-installed platforms or other equipment which easily may be damaged in case of a collision with such a heavy element during the submersion and installation of the element.

In the following specification, the elements which shall be submerged and positioned on the sea bottom are generally designated as "sink elements".

(2) State of the Prior Art

It is known to use large, heavy sink elements as permanent anchoring for tension leg platforms, bridge foundations or the like. In some cases such sink elements have a substantial weight. If cranes are utilized in connection with the immersion of the element, large demands must be be met in regard to crane capacity. The crane capacity, in addition to the weight of the sink element, also must be sufficient to sustain supplementary forces which will be created due to the movements of the crane vessel caused by winds, currents, etc., which movements inevitably will be transferred to the sink element via the crane cables. At larger depths, the weight of the cables themselves will inherently set a limit. This problem is sought to be avoided by using light weight cables made of new materials. Furthermore, the natural frequency of the system will increase from small and negligible values to values which are comparable or identical with the frequencies or periods for sea waves and/or with the natural frequency of the crane vessel.

It is also known to provide sink elements with positive buoyancy such that the immersion weight or force is being reduced or eliminated. The buoyancy is usually provided by designing the sink element with buoyancy chambers which may be filled with water or other ballast materials when the installation has been finalized.

It is furthermore known to connect sink elements with separate buoyant bodies or floats which, in connection with a controlled ballasting/deballasting procedure, are utilized during the immersion of the sink element, without the use of cranes, until the sink element is positioned at a short distance or height above the sea bottom and thereafter displace the sink element laterally until the preselected installation site has been reached. This preselected height above the sea bottom is defined with reference to the sea surface either on the basis of a crane or crane vessel (if such is used), or by means of a floating ballastable buoy, and where the last part of the immersion operation down to the sea bottom takes place by a controlled ballasting of the sink element "floating element", which is connected to the buoy with a cable having a preselected length. The buoy has a small water plane area, and has height along the water surface which exceeds the remaining height between the sink element and the sea bottom. This immersion procedure is shown in Applicant's U.S. Pat. No. 4,909,671. In Norwegian Patent application Ser. No. 88.2948 is shown in similar buoy utilized for identification of the position of the sink element during the immersion operation.

Regardless of which immersion system is being utilized, the movements and the position of the sink element, both vertically and horizontally, are being controlled from the sea surface.

Adequate control in the vertical direction is obtained by the known conventional system, and undesirable movements are eliminated. Thus, short amplitude movements induced by waves are eliminated by the insensibility of the system due to long natural frequencies, and the long amplitude movements which are induced by tide water is eliminated by adjusting the length of the cable (if the crane is utilized), or by means of ballasting/deballasting if a surface buoy is being utilized.

Undesirable movements in the horizontal plate are, however, induced by:

a) crane movements and hydrodynamic forces created by currents and waves, particularly in shallow waters, if a crane is being utilized, and b) hydrodynamic forces, substantially created by currents, if the sink element is installed utilizing either the buoyancy of the sink element itself or by means of supplied buoyancy.

These movements are sought to be counteracted from the sea surface in an "active" fashion by means of tension control of the control cables from an auxiliary vessel. If the applied tension from the vessel accidentally should fail (by cable failure, engine troubles, or anchor loosening), the control is lost, and the sink element initiates an uncontrolled movement. Unintended movements may also occur due to erroneous maneuvering of the auxiliary vessel. In order to limit the consequences of such incidents, it may be important to arrange special apparatus in order to protect existing installations on the sea bottom. Such apparatus may involve large expenses, since large forces are involved, and these forces may also easily cause damage to the sink element which, as a safe guard, must be protected in several ways.

SUMMARY OF THE INVNETION

The above problems are, in accordance with the present invention, resolved by using a procedure in connection with the immersion of large, heavy sink elements, whereby the sink element, in an initial procedure, is immersed until the sink element reaches a small preselected height above the sea bottom utilizing ballasting principles in a per se known fashion.

The invention is based on the idea that, in connection with finalizing the positioning and placement of the sink element on the sea bottom, a somewhat flexible, bottom based control of the sink element and its movements is obtained by connecting the sink element to a system of "clump weights", the position and movements of which may be controlled or monitored from the sea surface. With utilization of this solution, surface buoys and similar auxiliary equipment are superfluous.

A "clump weight" can be defined as a number of separate weights incorporated or attached along a flexible suspension means, such as a steel chain or a mat-like structure.

The method in accordance with the invention is more precisely that the sink element is provided with a number of circumferentially arranged downwardly suspended clump weights on the underside of the element, in chains or the like. Some or all of the clump weights are directly connected to an auxiliary vessel by a control cable or line, the lower end of which is connected to the lower or free end of each separate clump weight. The sink element with the attached clump weight is immersed, utilizing suitable means, until it assumes a stabilized elevational position a short distance or height above the sea bottom such that one or several of the clump weights contacts the sea bottom and, suitably, such that the unit is positioned at a certain lateral distance from the preselected final location site. Thereafter the sink element is displaced laterally to the location site by the auxiliary vessel or vessels by initiating a pulling action on the control cable or cables which are connected to the clump weight or weights located on the side of the sink element facing towards the desired direction of movement. When reaching the location site, the control cable or cables for the remaining clump weights are tightened from the auxiliary vessel in the directions pointing away from the sink element so that the clump weights, due to their suspension, effect a controlled adjustment and lateral stabilization of the sink element in a correct position just above the preselected location site. The sink element is then lowered down to the sea bottom by ballasting. Simultaneously the clump weights, including part of their suspension, take positions on the sea bottom along the outer circumference of the sink element.

The clump weights, together with their suspension, are able to hold the sink element at a certain balanced height above the sea bottom during lateral displacement regardless of the water level (i.e. the tide situation), and also regardless of whether the sea bottom is uneven or has a slope. All horizontal movements are counteracted by the friction drag created by the clump weights when being dragged along the sea bottom. The system is defined as "passive", i.e. no movements take place without the movements being imparted to the system from the auxiliary vessel or vessels located on the sea surface. This fact contributes to a large measure of safety versus uncontrolled movements.

One may use a surface based crane in replacement of buoyant bodies which are ballasted for immersion of the sink elements until the sink element assumes the preselected position above the sea bottom. The sink element may alternatively be provided with its own ballasting tanks or chambers, such that it constitutes a floating body prior to the immersion.

Theoretically it is sufficient that a single clump weight be connected with an auxiliary vessel, and it is fully possible to use only two clump weights altogether, one on each opposite side gf the sink element. But in order to obtain effective control of the movements of the sink element, three or more clump weights should be utilized, distributed along the circumference of the sink element, and at least two of the clump weights should be connected with a control cable to an auxiliary vessel.

The horizontal distance to the auxiliary vessel has only a small influence, i.e. constitutes nonsensitive parameter in the system when using clump weights suspended on control cables. The angular position of the control cables at the sea bottom may vary between 0° and 45°, a fact which permits a rather short horizontal distance between the auxiliary vessel and the sink element.

The weight and configuration of the clump weights are estimated on the basis of the need to obtain equilibrium between the water flow forces acting on the sink element (and the buoyant body, if such a body is used) and the frictional ground resistance against lateral drag movements of the clump weights. Sink elements having a submerged weight up to 3,500 tons may be installed by means of floating bodies requiring clump weights having a submerged weight of approximately 50 tons, calculated on the basis of rather adverse bottom and flow conditions.

Each sink element is transported to the selected position by pulling or towing the sink element/floating body to the installation site by the auxiliary vessel. The other, or opposite, clump weight cable is kept sufficiently slack such that a part of the longitudinal extension of this clump weight during the finalizing positioning operation will still scrape along the sea bottom. The position may be horizontally adjusted and vertically oriented by means of other auxiliary vessels. When the sink element including the floating body has reached the correct location site, a ballasting of the floating body/sink element is immediately carried out until the sink element has made good contact with the sea bottom in known fashion. The clump weights will in this position have a "stretched" configuration from the sink element because all forces which have been exerted on the clump weights have been directed in directions away from the sink element, i.e. a pulling from the auxiliary vessel on the one side, and the resistance from the sea bottom on the opposite side. The clump weights will therefore not interfere with the sink element to be seated on the sea bottom. Subsequent to the sink element having been positioned on the sea bottom and correctly levelled, the floating body and the clump weights are released from the sink element. The floating body, including the clump weights connected to the body, are deballasted and brought up to the sea surface while maintaining the coupling to the auxiliary vessels with the control cables. The floating body, including the clump weights, may in this condition immediately be used for new operations. The ballasting and deballasting of the floating body/sink element are controlled all of the time from the auxiliary vessel by means of a control line (umbilical). If a separate floating body is not being used, each clump weight can be left on the sea bottom or be removed, i.e. dumped to the bottom or taken up to the sea surface for further transport.

The clump weights advantageously comprise a number of concrete blocks coupled together with a flexible mat. Such a mat will form a defined area and weight distribution on the sea bottom and will thereby provide a basis for a dependable estimate of the ground resistance force along the sea bottom. The effectiveness of the clump weight mats may be increased by using ribs on the underside thereof which penetrate the uppermost layers of the sea bottom. Heavy chains can also be utilized either separately or in the form of chain mats. It is possible, and in some cases advantageous, to attach clump weights directly to the sink element. In such an application they may be permanently attached to the sink body and will finally rest on the sea bottom.

BRIEF DESCRIPTION OF THE DRAWINGS

The invention is further described below in connection with a preferred embodiment whereby a sink element is transported, immersed and positioned by means of a floating body and two clump weight mats, the embodiment being illustrated in the accompanying drawings, wherein similar reference numbers designate similar parts on all figures, and wherein.

DETAILED DESCRIPTION OF THE PREFERRED EMBODIMENTS

Figure 1:
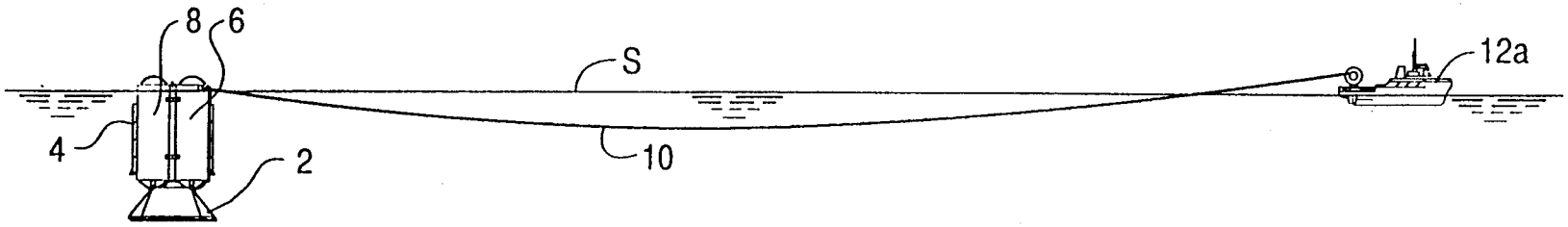
FIG. 1 schematically illustrates a sink element coupled to a floating body, which are both being towed to a location site.

FIG. 1 shows a sink element 2 directly attached to a floating body 4 comprising two vessels 6 and 8 which are being towed bY cables 10 to an installation site bY means of an auxiliary vessel or boat 12*a*. The sink element and the floating body are ballasted to a small freeboard in order to reduce the influence of waves and winds along the surface S.

Figure 2A:
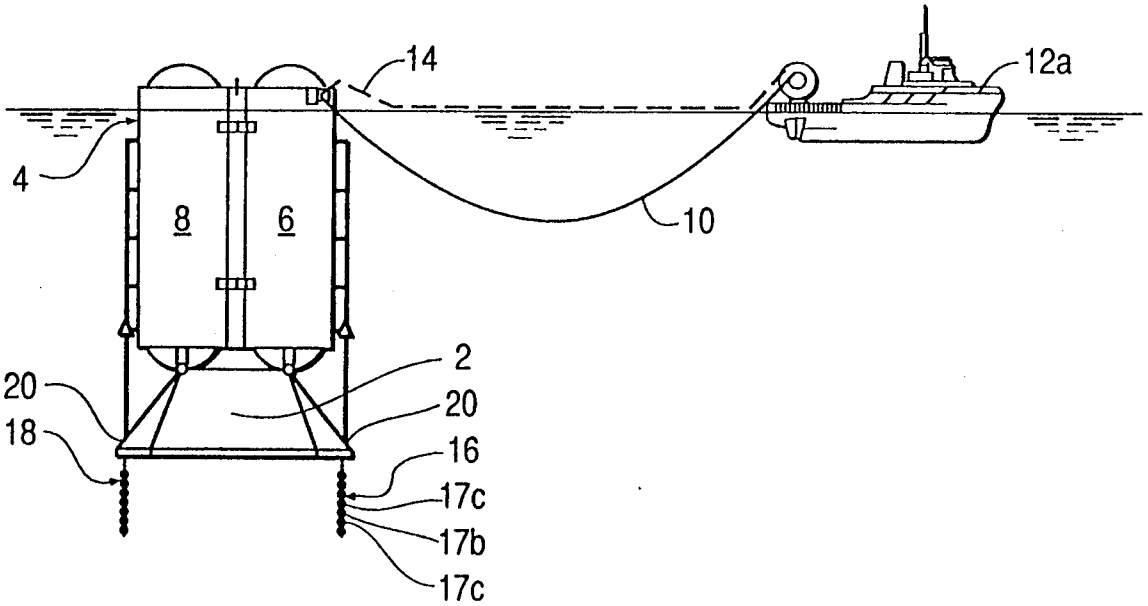
FIGS. 2*a–f* illustrate readymaking or clearing, immersion and positioning of a sink element provided with a floating body.

FIG. 2*a* illustrates the situation when the towing unit has reached the installation site. A control cable (umbilical) 14 is established between the auxiliary vessel 12*a* and the floating body 4 and the sink element 2. The umbilical 14 includes necessary lines for controlling the ballasting and deballasting and in order to carry out necessary coupling operations. The control cable or umbilical may, if necessary, be controlled and operated from a separate auxiliary vessel.

Figure 2B:
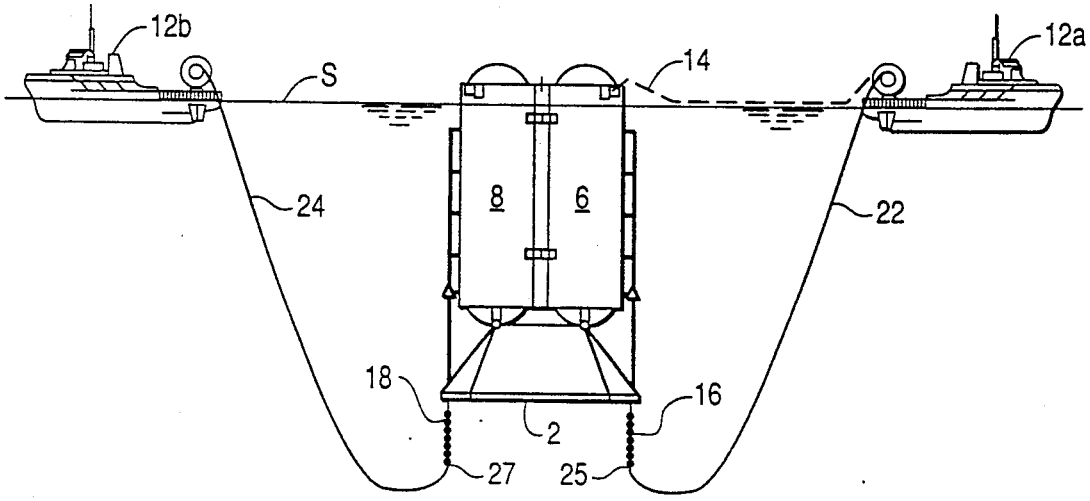
Figure 2C:
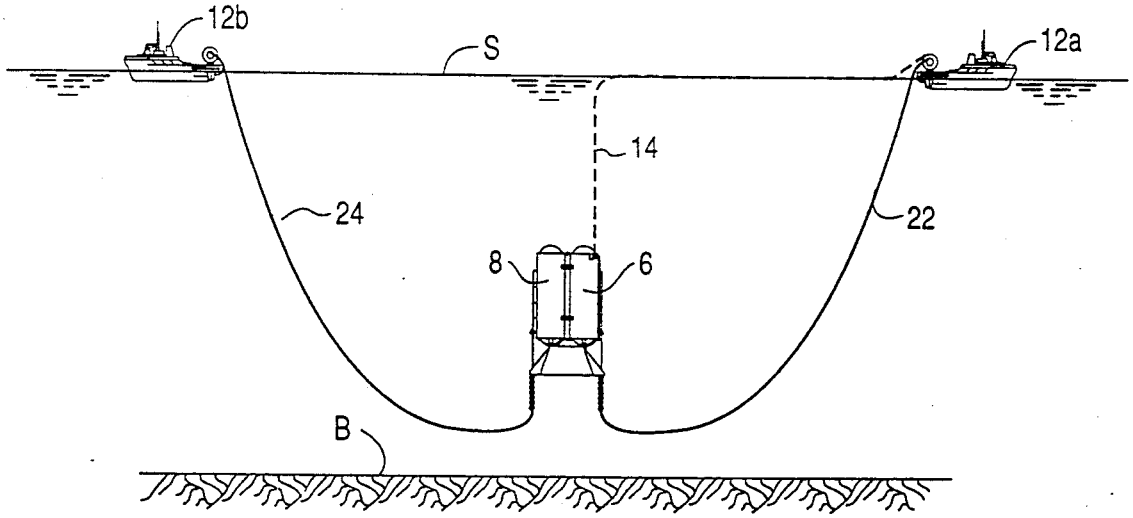
Figure 2D:
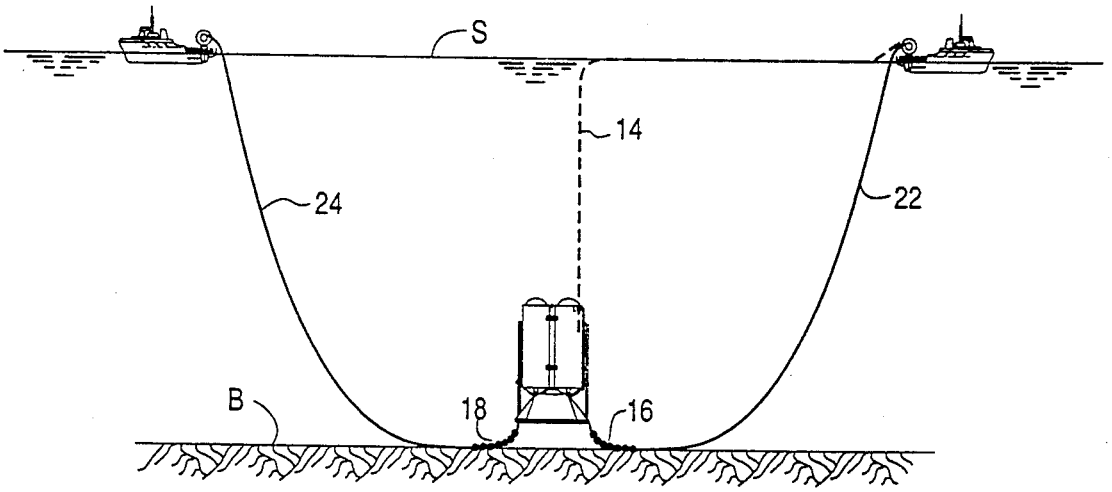

Two clump weights 16 and 18, which during the towing are attached along the sides of the floating body, are lowered and suspended downwards along the side of the lowermost end of the sink element. In a preferred alternative, an attachment point 20 is established far down on the sink element in order to absorb horizontal forces from the clump weights during a positioning operation. FIG. 2*b* shows lowermost ends 25 and 27 on the clump weights, which ends have been attached to cables 22 and 24, respectively, each of the cables being controlled from a separate auxiliary vessel 12*a* and 12*b*. FIG. 2*c* illustrates the immersion or sinking operation sinking the sink element 2 towards the sea bottom B. The ballasting is controlled through the umbilical 14. The cables 22 and 24 are maintained slack, and do not participate in the immersion operation. In FIG. 2*d* the clump weights are partly resting on the sea bottom, and through a control ballasting, the sink element, including the buoyant body 4 and the still suspended part of the clump weights 16 and 18, are ballasted until an equilibrium state has been reached, resulting in the sink element 2 attaining a certain height above the sea bottom B with part of the clump weights 16 and 18 resting on the sea bottom B. Thereby a kind of "anchoring" of the sink element 2, including the floating bodies 6 and 8, is secured in a location where the final positioning can be initiated (for instance about 100–500 m from the installation site).

Figure 2E:
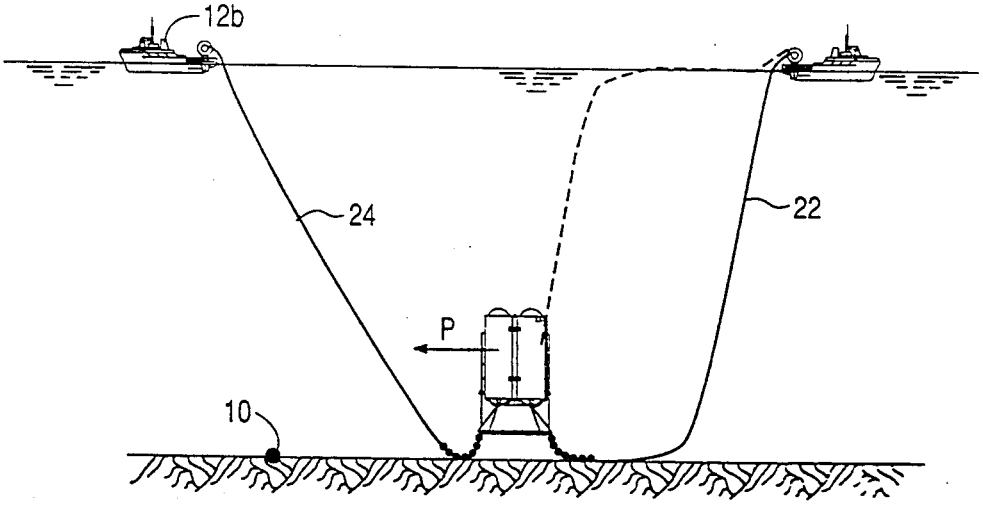
Figure 2F:
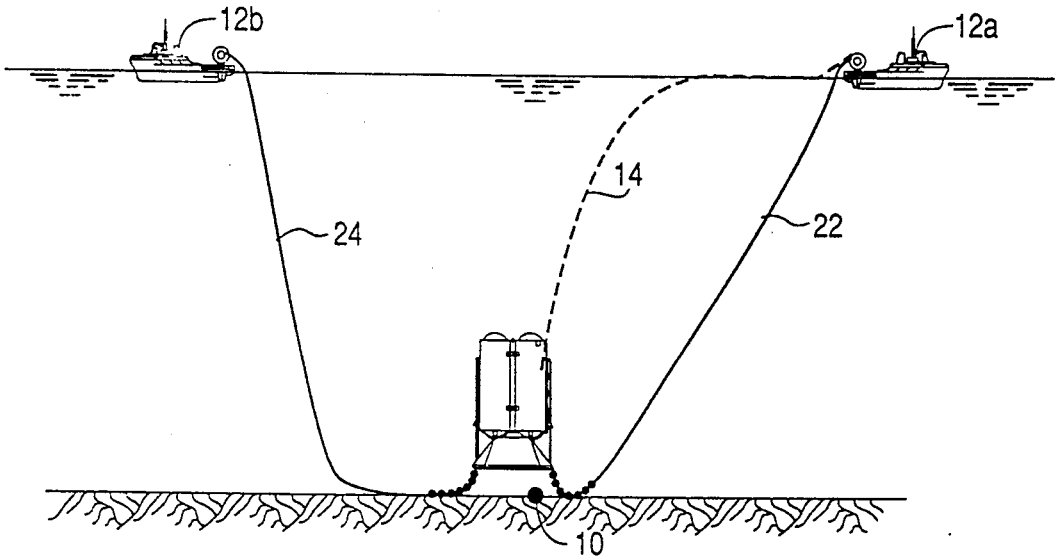

In FIG. 2*e* is shown how the sink element is being pulled in the direction P toward an installation site 10 along with the attached floating bodies 6 and 8 via cable 24 which extends to one of the auxiliary vessels 12*b*. The other auxiliary vessel 12*a* continuously maintains the cable 22 slack. FIG. 2*f* shows how the second auxiliary vessel 12*a* may contribute to a corrugation of the position of the sink element 2, accomplished by a minor retractive movement.

Figure 3A:
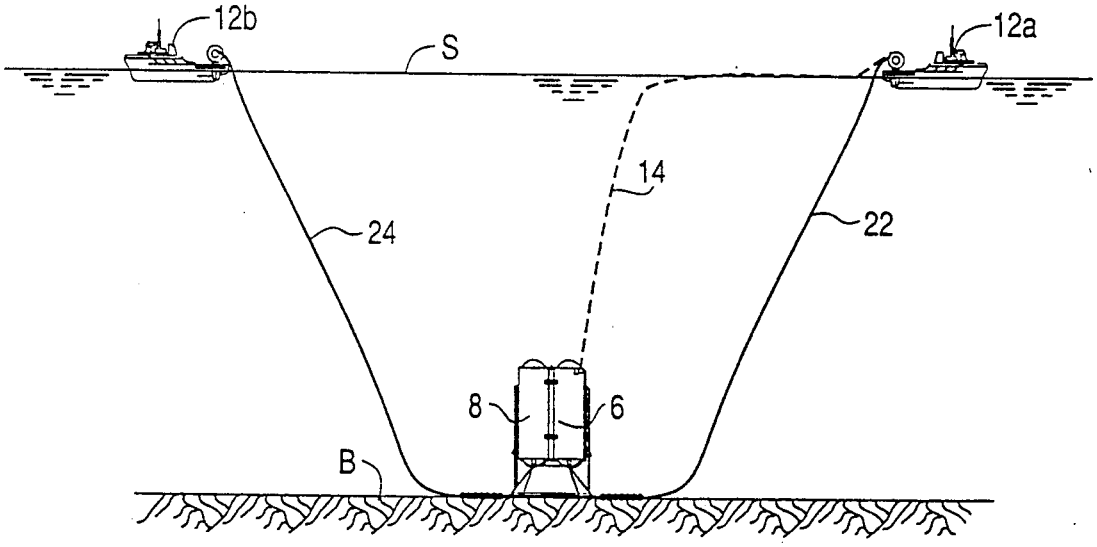
FIGS. 3*a–c* illustrates the sink element in position on the sea bottom and removal of the floating body, including cables and clump weights, from the sink element.
Figure 3B:
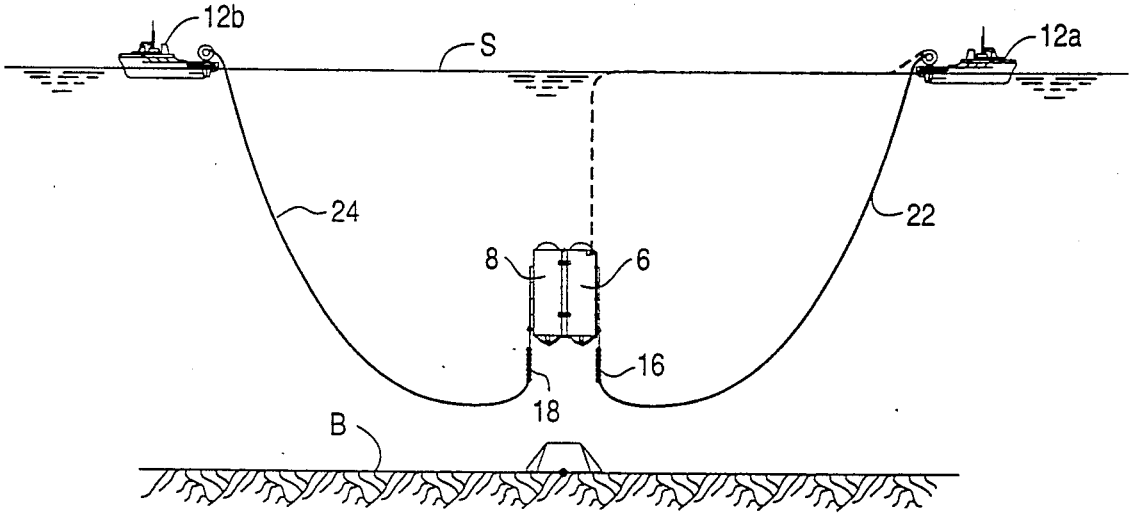
Figure 3C:
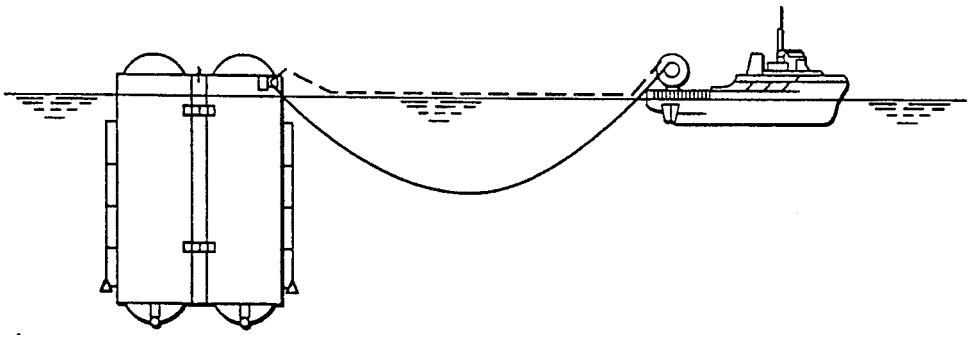

The sink element 2, by means of the clump weight system, has then been accurately positioned straight above the location site 10. The floating bodies 6 and 8 (alternatively, ballast tanks in the sink element 2), are ballasted, having the effect that the sink element 2 is seated into dependable bottom contact on or straight above the location site 10 as illustrated in FIG. 3*a*. Thereafter the attachment point 20 (see FIG. 2*a*) on the sink element 2 for the suspension of the clump weights and the coupling between the sink 2 and the floating bodies 6 and 8 are released. The floating bodies 6 and 8, including the clump weights 16 and 18 and the control cables 22 and 24, ascend toward the sea surface as shown in FIG. 3*b*. Thereafter the control cables 22 and 24 are released, and the control line (umbilical) 14 and the clump weights 16 and 18 are pulled up to a transport position on the floating bodies 6 and 8, whereafter they are towed away in order to carry out a new operation, as shown in FIG. 3*c*.

Figure 4A:
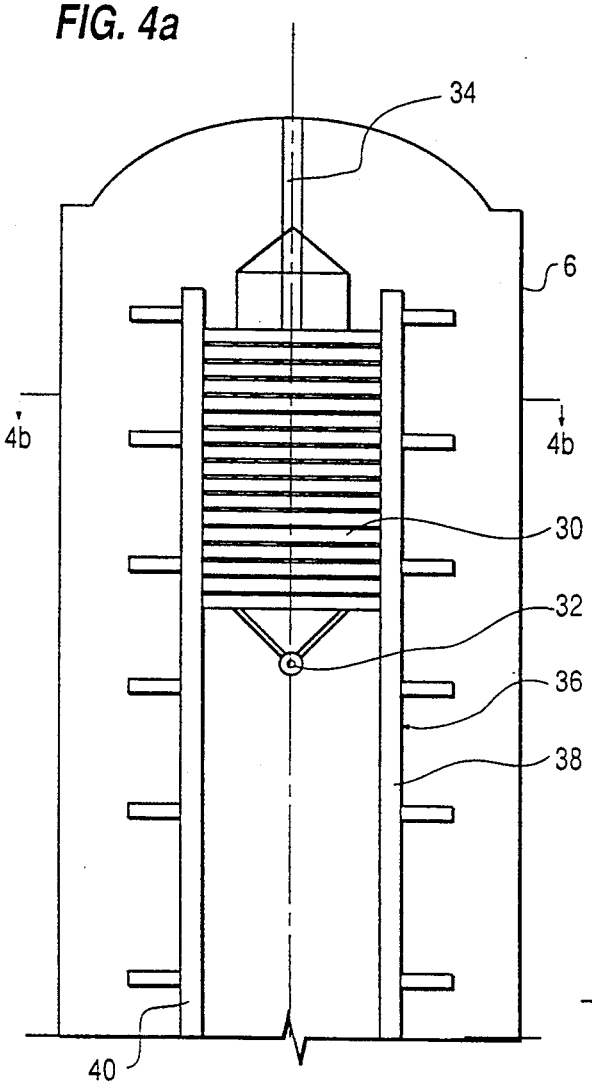
FIGS. 4*a–d* illustrates clump weights adapted for a floating body comprising two concrete vessels, whereby the clump weights also are utilized for trimming the vessels during certain steps during their utilization. The principles for using the clump weights during installation of sink elements without the use of a floating body are substantially the same and are thus not specifically illustrated.
Figure 4B:
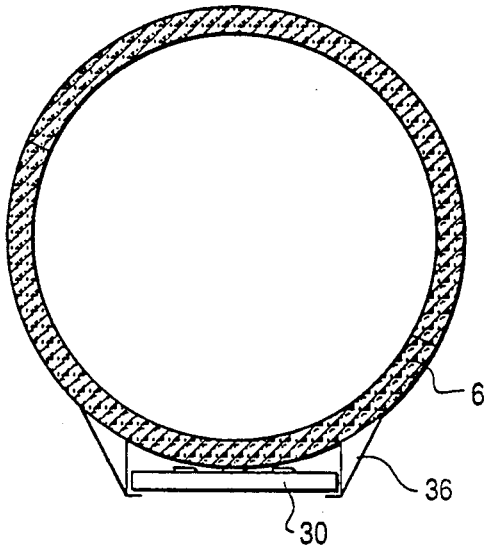

FIG. 4*a* shows the floating body 6 viewed from the side. A clump weight mat 30, including a control cable attachment 32 and a hoisting and lowering cable 34, is secured or locked into a transport position by a locking and guiding mechanism 36 having oppositely positioned guide rails 38 and 40. FIG. 4*b* shows a section through floating body 6 with the clump weight mat 30 in transport position.

Figure 4C:
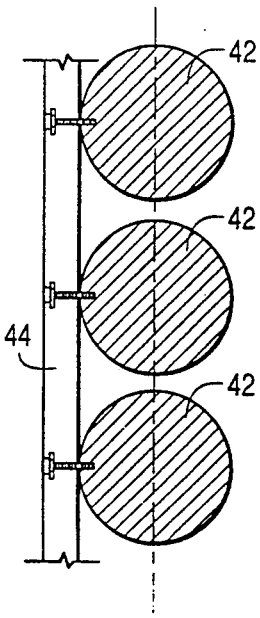

FIG. 4*c* shows a section through part of a clump weight mat 30, wherein separate elements 42 are shaped as cylinders and provided with a rubber backing 44 facing the elements in order to dampen possible shocks incurring during the lowering of the mat 30 shown in FIG. 4*a*. The elements 42 may be provided with ribs (not shown) between and protected by rubber backing 44, which together with the ribs penetrates the sea bottom and increases the effectiveness of the mat 30.

Figure 4D:
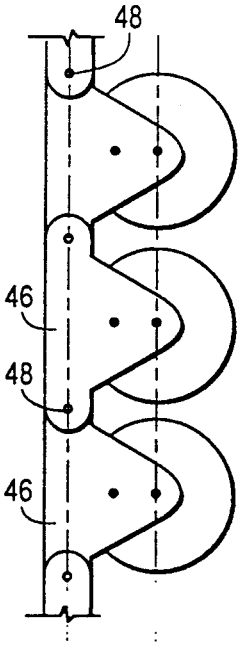

FIG. 4*d* shows a part of the mat 30 viewed from the side. The elements 42 are attached to holding plates 46 which are intercoupled by means of non-rotative couplings 48 in order to form a chainlike structure.

The clump weights may be vertically movably mounted on the sink element as well as the floating bodies 6 and 8. When the sink element is finally ballasted to its final location site, the clump weights may be gradually raised simultaneously with the lowering of the sink element 2 onto the final location site on the sea bottom so that the clump weights are substantially suspended on the outside of the sink element after the sink element has contacted the sea bottom. During the step of immersing the sink element, the sink element may be provided with a buoyant force so that the sink element has an acting weight so that the sink element will sink toward the sea bottom at a predetermined velocity and reach the equilibrium elevational position spaced above the sea bottom without further adjustment of the buoyant force when the clump weights have reached an elevational position with at least some of the clump weights resting on the sea bottom. The weights may be suspended from a lower portion of the sink element. Preferably, they are attached to a lower circumferential portion of the sink element on the outside thereof.

I claim:

1. A method for the controled immersion and positioning of a sink element on the sea bottom, comrising the steps of:

providing a sink element to be immersed and sunk to the bottom of the sea having a weight system suspended therefrom;

provding an auxiliary surface vessel having a control cable directly connecting siad vessel with siad weight system suspended from siad sink elemetn;

immersing siad sink element with siad weiht system suspdned therefrom until siad weight system contacts the sea bottom and siad sink element reaches a preselected stabilized equilibrium elevational postion above the sea bottom; and laterally displacing siad sink element and siad weight system suspdneded therero mwhile substantially maintainign the heigth of siad sink element above the sea bottom towards a final sinl elemetn location site by having siad auxiliary surface vessel pull on siad control cable connected to sadi weight system in a direction of movement towards hte final location site; and when siad sink element has substantially arrived at the final location iste, ballasting siad sink elemetn such that sadi sink elemetn is lowered onto the final location site on the sea bottom.

2. The method of claim 1, wherein, in siad step of laterally dipsplaicng said sink elemnet, poritons of siad weigh system are in conatact with and dragged across the sea bottom.

3. The method of claim 1, wherein said sink element has a lower peripheral edge, siad weight system being suspended from siad lower peripheral edge.

4. The method of claim 3, wherein siad weight system comrises a plurality of clump weighs suspended from siad lower peripheral edge of said sink elemetn, said control cable being connected to one of said clump weights.

5. The method of claim 4, wherein two said clump weights are provided postioined on opposite sides of siad sink elemetn, and a second auxiliary vessel is proivded having a second control cable directly connecting siad seocnd auxiliary vessel to one of siad clump weights such that said control cables are connected to resepctive opposite clump weights.

6. The method of claim 5, wherein siad step of immersing comprises providing said sink element with a buoyant force such that said sink element has an acting wegith such that siad sink element will sink toward the sea bottom at a predetermined velocity and reach the equilibrium elevational postiion spaced above the sea bottom without further adjustment of the buoyant force when siad clump weights have reached an elevational position with at least some of siad clump weights resting on the sea bottom.

7. The method of claim 6, wherein in siad step of laterally displacing siad sink elmeent, at least one of siad clump weights is in contact with and dragged along the sea bottom.

8. The method of claim 4, and further comprising provdiing a control cable for each siad clump weight and, after said step of laterally displacing and before siad stpe of ballasting, radially displacing all of siad clump weigths outwardly from said sink element such that after siad step of ballasting siad clump weights will be located in a positoni resting on the sea bottom outwardly of siad sink element.

9. The method of claim 4, wherein siad clump weigths are vertically movable mounted on siad sink element for movement between a positoin vertically spaced above said lower peripheral edge and a postiion at siad lower peripheral edge, and during sadi step of ballasting siad clump weigths are gradually raised simultaneously with the lowering of siad sink element onto the final location site on the sea bottom such that siad clump weights are substantially suspended on the outside of siad sink element after said sink element has contacted the sea bottom.

10. The method of claim 4, wherein:

during siad step of immersing said sink element said sink element is releasably attached to the underside of at least one buoyant body having adjustable buoyancy; and said clupm weights have upper ends thereof releasably suspended on siad buoyant bodies such that siad clump weigths are downwardly suspended along the outside of siad sink elemetn to a predetermined distance elow siad sink element.

11. The method of claim 4, wherein siad sink element has adjustable buoyancy and is capble of lfoating with siad clump weights suspended therefrom.

12. An apparatus, comrising:

a sink element to be immersed from a flating position on the sea and lowered to a position above the sea bottom; and a weigth means for holding the positon of siad sink element above the sea bottom by siad weight meas contacting the sea bottom before siad sink element contacts the sea bottom during descent of the sink element toward the sea bottom and for enabling siad sink element to be laterally displaced toard a final location site while saced above the sea bottom by said weigth means being in contact with and dragged across the sea bottom, siad weight menas comprising a plurality of weights suspended below siad sink element;

wherein at least two clump weights are formed by sadi plurality of weigths, said clump weights being provided on opposite sides of a lower circumferential portion of said sink element; and wherein each siad clump weight comprises a pluraity of concrete blocks as said weights coupled together in a flexible mat.

13. An apparatus, comprising:

a sink element to be immersed from a flating position on the sea and lowered to a position above the sea bottom; and a weigth means for holding the positon of siad sink element above the sea bottom by siad weight meas contacting the sea bottom before siad sink element contacts the sea bottom during descent of the sink element toward the sea bottom and for enabling siad sink element to be laterally displaced toard a final location site while saced above the sea bottom by said weigth means being in contact with and dragged across the sea bottom, siad weight menas comprising a plurality of weights suspended below siad sink element;

wherein at least two clump weights are formed by sadi plurality of weigths, said clump weights being provided on opposite sides of a lower circumferential portion of said sink element; and wherein each siad clump weight comprises a pluraity of cylindrically shaped bodies as said weights, siad bodies being linked together side by side to define a flexbiel mat.

14. The apparatus of claim 13, wherein each siad clump weight is proivded with a guide device for vertically guiding siad clump weight relative to siad sink element, each siad guide device comprising a pair of spaced railings fixed relative to sadi sink element.

15. The apparatus of claim 14, and further comprising means for remotely controlling the raising and lowering of siad clump weights relative to said sink element such that the height of said sink element above the sea bottom can be adjusted when siad clump weigths are in at least partial contact with the sea bottom.

16. The apparatus of claim 15, wherein siad guide devices are on the outside of siad sink element and said clump weights are permanently mounted on siad guide devices.

17. The apparatus of claim 15, wherein said sink element is provided with a buoyant body from the udnerside of which said isnk element is releasably suspended, said clump weights being attached on said bouyant body.

18. The apparatus of claim 15, wherein said clump weights are mounted in releasable siad guide devices attached to the outside of siad sink element.

19. An apparatus, comprising:

a sink element to be immersed from a flating positon on the sea and lowered to a postion above the sea bottom; and a weigth means for holdign the position of siad sink element above the sea bottom by siad weight means contacting the sea bottom before siad sink element contacts the sea bottom during descent of the sink elemebtn toward the sea bottom and for enabling siad sink element to be laterally dispalced toward a final location site while spaced above the sea bottom by said weight means being in contact with and dragged across the sea bottom, said weight means comprising a pluraliyt of weigths suspended below siad sink element;

wherein siad weights are coupled together to define a flexible mat.

20. The apparatus of claim 19, wherein siad weights are suspended from a ower protion of said sink elemetn.

21. The apparatus of claim 19, wherein said plurality of weights are conencted together in at least one chain to make up at least one clump weigth, siad clump weiht being attached to a lower circumferential portion of said sink element.

22. The apparatus of 21, wherein siad clump weight has an upper end attached to an edge of siad lower circumfernetial protion on the outside of sadi sink element.

23. The apparatus of claim 14, wherein at least two clump weights are formed by sadi plurlaity of weights, siad clump weights being provided on opposite sides of a lower circumferential portion of said sink element.

24. The aparatus of claim 23, wherin siad sink element comprises means for changing the buoyancy of siad sink elemetn and enabling said sink element to float on the sea together with said clump weight.

25. An apparatus, comprising:

a sink elemetn to be lowered from a floating position to a postion at rest on teh sea bottom; and at least two clump weigths each having one end thereof attached ot the outside of siad sink element on opposite sides of siad sink elemet, each siad clump weight comprising a plurality of concrete blocks coupled together in a chain to form a flexible mat.

* * * * *